United States Patent [19]

Barouh et al.

[11] 3,998,314

[45] Dec. 21, 1976

[54] IMPACT TYPEWRITER CORRECTION TAPE AND METHOD OF MANUFACTURE

[76] Inventors: Victor Barouh, 111 Wheatley Road, Old Westbury, N.Y. 11568; Robert Glenn, 400 E. 56th St., New York, N.Y. 10022

[22] Filed: Nov. 13, 1975

[21] Appl. No.: 631,567

[52] U.S. Cl. ..... 197/181; 106/245; 427/207 R; 428/352; 428/356

[51] Int. Cl.[2] ..... B41J 29/00; B41J 31/00

[58] Field of Search ..... 106/245, 268, 271; 101/336; 197/172, 181; 427/207; 428/352, 356, 411, 539

[56] References Cited

UNITED STATES PATENTS

| | | | |
|---|---|---|---|
| 1,916,203 | 7/1933 | Carr | 106/245 X |
| 2,483,259 | 9/1949 | Budner et al. | 106/245 |
| 2,767,650 | 10/1956 | Yunker et al. | 197/181 |
| 2,842,454 | 7/1958 | Short | 106/268 |
| 3,282,709 | 11/1966 | Ehrhardt et al. | 106/268 X |
| 3,552,990 | 1/1971 | Barouh | 428/539 X |
| 3,724,633 | 4/1973 | Korb et al. | 197/181 X |
| 3,776,756 | 11/1973 | Barouh et al. | 427/152 |
| 3,889,310 | 6/1975 | Barouh et al. | 197/181 X |
| 3,924,728 | 12/1975 | Brown et al. | 197/172 |

*Primary Examiner*—Edgar S. Burr
*Assistant Examiner*—Paul T. Sewell
*Attorney, Agent, or Firm*—Ladas, Parry, Von Gehr, Goldsmith & Deschamps

[57] ABSTRACT

A typewriter correction tape adapted to lift off an erroneous typewritten character from the paper on which it was typed including an impact compressible material coated on a substrate film, and method of manufacture thereof.

6 Claims, 6 Drawing Figures

FIG. 1
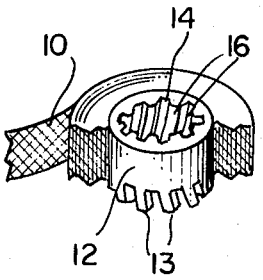
FIG. 2
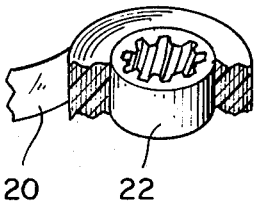
FIG. 3
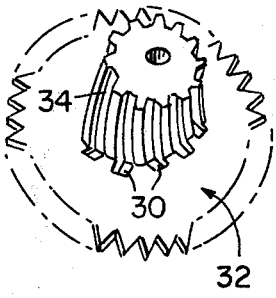
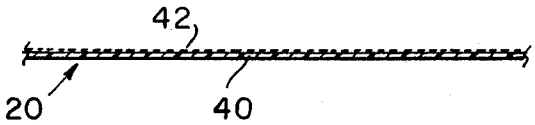
FIG. 4
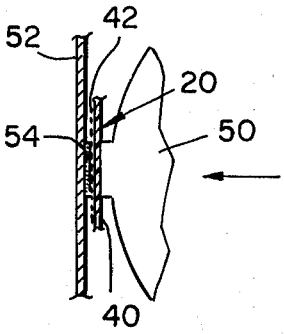
FIG. 5
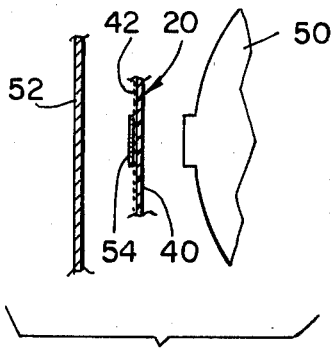
FIG. 6

IMPACT TYPEWRITER CORRECTION TAPE AND METHOD OF MANUFACTURE

BACKGROUND OF THE INVENTION

1. Field of the Invention

This invention relates to a typewriter correction tape employing an impact compressible layer and is especially adapted for use in conjunction with typewriter ribbons of the type that are coated with a non-absorbent and substantially non-compressible carbon ink. The correction tape is especially adapted for use in conjunction with a ribbon feed mechanism of a typewriter such as the Correcting Selectric typewriter manufactured by International Business Machine Corp.

2. Description of the Prior Art

The earliest materials for correcting errors in a typed page were gum erasers. The ink composition on the typewriter ribbon in use at that time was absorbed into the paper and attempts at erasure of a typed character often resulted in tearing the paper on which the error was typed.

There was later developed non-absorbent ink compositions of transfer materials, which do not wet or dye the paper onto which typed characters are printed. This made possible the use of adhesive materials for correcting an error by removing the undesired typed character with an adhesive composition. Thus, a typed character made by a ribbon coated with a non-absorbent, non-penetrating, non-wetting ink can be removed from the paper by contacting the paper with an adhesive composition which lifts the typed character from the paper.

It is further known, to provide in a typewriter, such as that designated a Correcting Selectric Model manufactured by IBM, a ribbon mechanism which feeds a print ribbon for a typing operation and an adhesive erase ribbon which can be fed by such feed mechanism to supplant the ribbon for a correction operation.

The difficulty involved with the known adhesive correction ribbons is that the adhesive material required for removal of the typed indicia from the paper, or print medium, also adheres to various parts of the typewriter or to itself.

This often causes jamming of the feed mechanism and the malfunction of the correction operation. Further, the earlier adhesive correction ribbons adhered to the alignment shield of the typewriter or to the paper during its use for removing a typed character which required the manual manipulation of the typist. Jamming or adhesion of the correction ribbon to the machine meant the removal of the correction ribbon manually, in order to re-adjust the supply and take-up spools of the correction ribbon, which is inconvenient and costly in time and effort.

SUMMARY OF THE INVENTION

It is an object of the present invention to provide an impact means to lift off incorrect characters typed with ribbons having non-absorbent, non-penetrating, non-wetting and non-compressible ink compositions. The correction tape features an impact compressible layer having sufficient qualities to lift the undesired typed character from the paper or print medium, but being non-tacky to the touch and exhibiting no self adhesion, or sticking to the machine parts or the paper during the correction operation, and during the insertion of the ribbon into the feed mechanism of a typewriter.

It is another object of the present invention to provide a correction tape that when pressed into engagement with the surface of typing paper where there is not indicia present, the tape will readily release from the paper and not lift off or tear any of the fibers of the paper.

The ribbon of correction material in accordance with the present invention will flow freely from a supply spool and readily be fed along the alignment shield of a typewriter without adhering thereto, or to the paper, on being struck thereagainst for a correction operation.

The ribbon of correction material in accordance with the present invention may be manufactured by coating a substrate with the aforesaid impact compressible composition. The substrate or carrier material may be of any suitable thin sheet material or film such as paper, plastic film sold under the trademark Mylar, polyethylene, acetate, nylon or the like.

It is a further object of the present invention to provide a simple and inexpensive method of making a correction material for use with a non-wetting typewriter ribbon of the type that is transferred and deposited on the typing bond.

The foregoing together with various ancillary objects, features and advantages of the invention will become apparent from the following description of preferred embodiments which are illustrated in the attached drawings by way of example only.

BRIEF DESCRIPTION OF THE DRAWINGS

FIG. 1 is a perspective view of a conventional supply roll of adhesive correction material and a carrier core, shown with the ribbon broken away to better expose the core;

FIG. 2 is a perspective view of a supply roll of a typewriter correction tape made in accordance with this invention and a carrier core, shown broken away to better expose the core;

FIG. 3 is a perspective view of a supply spool support member employed in the correction feed mechanism of the IBM Correctable typewriter;

FIG. 4 is a side elevational view of the correction tape;

FIG. 5 is a schematic view showing the correction tape during impact with a typed indicia; and FIG. 6 is a schematic view showing the correction tape after impact lifting the indicia from the typing paper.

DETAILED DESCRIPTION OF THE INVENTION

With reference to the accompanying drawings wherein like reference numerals designate similar parts, there is shown in FIG. 1 a conventional adhesive correction tape 10 wound around a core 12. Depending from core 12 are a plurality of spline extensions 13 that are designed to extend through the plurality of openings 30 in the support member 32, of the typewriter feed mechanism, as may be seen in FIG. 3.

Core 12 has an opening 14 in the center thereof with a plurality of elongated spiral slots 16 at the edges therefore which are designed to engage the elongated spiral teeth 34 of member 32.

The tacky quality of the conventional earlier correction ribbons and tapes prompted elaborate drive means and tensioning systems to be devised in an effort to try to prevent the ribbon 10 from sticking to the various parts of the typewriter during the feeding operation. The spline extensions 13 extended through openings 30 to trigger a special tensioning mechanism in the feed mechanism, not shown herein.

The slots 16 of core 12 engage the teeth 34 of member 32 when disposed thereon. Support member 32 is part of a feeding means for tape 10 that serves to move the ribbon 10 into the correct position for a correction.

In FIG. 2, the impact correction tape 20 of the present invention is depicted wound on core 22. Tape 20 is especially adapted such that it does not require the special tensioning that was necessary with conventional correction ribbons. Accordingly, the tape 20 may be wound on any suitable core that will be received by the feed mechanism of a typewriter, such as core 22.

The tape 20 comprises a substrate 40 that is coated by any conventional method with an impact compressible material 42. The substrate 40 is preferably manufactured of a synthetic flexible material such as cellophane or plastic film sold under the trademark Mylar, of a thickness of 1 mil, but may be coated on any suitable material such as nylon film, acetate film, paper or the like, of any suitable thickness. The material 42 is coated on the substrate 40 and then slit and wound on any suitable core. The compressible material when coated on a film such as mylar will dry sufficiently to be non-tacky to the touch.

In operation, the correction tape 20 is movably disposed between the keys or single element of the typewriter 50 and the typing paper 52 which has a typewritten character 54 thereon. The indicia 54 is produced from a typewriter ribbon, not shown, having a non-absorbent, non-penetrating, non-wetting ink that is transferred from the ribbon to the paper 52. The character 54 adheres to the surface of the typing paper without bleeding into the fibers of the paper 52.

The correction tape 20 is held in position by the feed mechanism of a typewriter such that the element 50, of the machine strike the rear of tape 20 pressing the coating 42 into rapid engagement with the indicia 54 that is to be removed. The impact coating 42 is deformed slightly by the element 50 forcing it into direct coextensive engagement with the typed character 54 that extends outwardly from the surface of the paper 52 toward the correction tape 20.

The substrate 40 is sufficiently flexible that it allows for the deformation of the coating material 42, when struck by element 50.

The coating 42 is forced into coextensive engagement with the indicia 54 by striking the tape with the same key as used to create the indicia 54. When the element 50 moves rearwardly away from the tape 20 the tension in the tape 20 created by the feed mechanism and the resilient property of substrate 40 serve to pull the tape 20 away from the surface of the paper 52.

The coating that is pressed into coextensive engagement with the surface of character 54, and the subsequent movement of the tape directly away from the paper, serve to lift the typed character completely off the paper 52 and is held by the coating 42. The indicia 54 is held by the tape 20, as shown in FIG. 6, and the tape is longitudinally advanced by the feed mechanism from its previous location to expose a new unused portion of the tape at a position corresponding to the location of the newly deposited typed characters.

The paper 52 surrounding the indicia 54 does not adhere to the coating 42 and is not physically effected by the correction operation. The fibers of the paper 52 remain intact and undamaged and will readily receive a new character that is typed thereon.

The coating 42 is non-tacky to the touch and accordingly will not adhere to itself, or to the guiding parts of the typewriter such as the aligning shield. Should pressure be applied to the tape when in engagement with an undesired part of the machine, the tape 20 does not stick readily thereto and accordingly will easily disengage therewith when extremely slight tension is applied longitudinally to the tape 20. Therefore, the tape 20 will not jam the feeding mechanism or require special tensioning of any sort.

The substrate 40 is coated on at least one side, and the tape is fed into the typewriter with the coating 42 facing the paper.

Examples of the formula for the impact correction coating 42 are as follows:

EXAMPLE I 25 parts Aluminum Stearate
5 parts Barium Lanolate
70 parts Toluol.

Rhodamine, or any suitable dye, may be added in trace amounts to make the coating visible.

The components can be mixed at a temperature of approximately 130° F. and the formulation coated as a solution with the evaporation of the solvent Toluol. The mixture of this example may also be allowed to cool to room temperature before being coated onto a suitable substrate.

EXAMPLE II 50 parts Aluminum Stearate
10 parts Lanolin
40 parts Carnauba Wax

The lanolin and Carnauba Wax act as a carrier for the aluminum stearate. The components of the formulation are melted at a temperature of about 200° to 212° F., for 5 to 10 minutes, and then mixed in a high speed mixer. The resultant mixture is coated on the substrate by any suitable hot melt application and then is dried by solidification. This example does not utilize a solvent and accordingly, does not require evaporation thereof.

The relative amount of each component in the formulations noted in the examples have been found to produce extremely effective coatings, however wide variations are contemplated.

Talc may be added to any of the examples to alter the surface feeling of the coating 42 and does not effect the ability of the coating to effectively lift off the undesired indicia. The coating 42 manufactured in accordance with any of the above examples adapts the tape 20 to exhibit substantially no attraction to the feed mechanism of the typewriter, while it allows the tape 20 to effectively function as a lift-off typewriter correction tape.

A latitude of modification, substitution and change is intended in the foregoing disclosure and in some instances, some features of the invention may be employed without a corresponding use of other features.

What is claimed is:

1. A typewriter correction material which comprises a substrate film and an impact coating on said substrate to lift off a typed character formed from a non-wetting ink when pressed into engagement therewith, said coating being a mixture including substantially 25 parts aluminum stearate, 5 parts barium lanolate and 70 parts toluol.

2. A typewriter correction material which comprises a substrate film and an impact coating on said substrate to lift off a typed character formed from a non-wetting ink when pressed into engagement therewith, said coating being of a mixture of substantially 50 parts aluminum stearate, 10 parts lanolin and 40 parts Carnauba Wax.

3. A method for making a non-tacky correction material, which comprises the steps of mixing substantially 25 parts aluminum stearate, 5 parts barium lanolate and 70 parts toluol at a temperature of about 130° F., allowing said mixture to cool, coating said mixture on a thin substrate wherein said substrate is a material selected from the group consisting of paper, plastic film, polyethylene, acetate or nylon.

4. A method for making a correction material, which comprises the steps of mixing substantially 50 parts aluminum stearate, 10 parts lanolin and 40 parts Carnauba Wax at a temperature of about 200° F., coating said mixture on a thin substrate wherein said substrate is a material selected from the group consisting of paper, plastic film, polyethylene, acetate or nylon, and drying said mixture by solidification.

5. A method for making a non-tacky correction coating material which comprises the steps of mixing substantially 50 parts aluminum stearate, 10 parts lanolin and 40 parts Carnauba Wax in a vessel at about 200° to 210° F., for 5 to 10 minutes, and then mixing in a high speed mixer to form said coating material.

6. A method for making a non-tacky correction material which comprises the steps of mixing 25 parts aluminum stearate, 5 parts barium lanolate, and 70 parts toluol to form a coating mixture, and evaporating said toluol after coating said mixture on a substrate.

* * * * *